United States Patent [19]

Allen et al.

[11] 4,232,649

[45] Nov. 11, 1980

[54] BOW STRING TRIGGER RELEASE

[76] Inventors: Holless W. Allen; Douglas T. Allen, both of Billings, Mo. 65610

[21] Appl. No.: 906,944

[22] Filed: May 16, 1978

[51] Int. Cl.[3] ..... F41B 5/00

[52] U.S. Cl. ..... 124/35 A

[58] Field of Search ..... 124/35 A, 24 R, 23 R, 124/41 A, 22

[56] References Cited

U.S. PATENT DOCUMENTS

| | | | |
|---|---|---|---|
| 229,089 | 6/1880 | Burnham | 124/35 A |
| 3,461,852 | 8/1969 | Brothers | 124/35 A |
| 3,898,974 | 8/1975 | Keck | 124/35 A |
| 4,022,181 | 5/1977 | Fletcher | 124/35 A |
| 4,036,204 | 7/1977 | Scott | 124/35 A |

*Primary Examiner*—Richard C. Pinkham
*Assistant Examiner*—William R. Browne
*Attorney, Agent, or Firm*—D. A. N. Chase

[57] ABSTRACT

A trigger-operated bowstring release especially designed for hunting has an elongated, rigid body of dog-leg configuration, the rear portion of the body presenting a handle which is gripped by the archer to hold the release in the shooting position. The tip of the front portion is tapered and houses a rotary holding member having an open, bowstring-engaging hook that normally projects clear of the body and laterally outwardly from the side thereof that faces away from the archer when the release is held in the shooting position. The member is engaged by a sear carried by a trigger spaced rearwardly from the hook adjacent the handle where it may be operated by the index finger of the shooter; thus the hook receives and holds the bowstring until the trigger is operated to disengage the sear. Two return springs automatically reset the hook and trigger after the bowstring is released to permit rapid initial and repeat shots.

20 Claims, 10 Drawing Figures

BOW STRING TRIGGER RELEASE

This invention relates to improvements in trigger-operated releases used in archery and, in particular, to a release that is especially suited for hunting due to the ease by which the bowstring is engaged, pulled and held and the ability of the release to permit rapid initial shots and repeat shots.

Releases have become increasingly popular among archers in recent years as an aid to drawing the bowstring, holding the string in the fully drawn position, and then releasing the string when desired to cast the arrow. A release is of considerable aid to the archer in that it not only assists him in drawing and holding the bowstring but, most importantly, establishes a uniform release of the string and eliminates lateral deflection of the arrow to increase accuracy and consistency.

A release in its simplest form may be referred to as a single-component release, which is simply one hand-held part having a notch or edge that captures the bowstring and releases it upon rotation of the archer's hand. More sophisticated voluntary releases include the two-component type which commonly employs a trigger and a rotating holding member that captures the bowstring and then releases it when the trigger is depressed. There is also a three-component type which utilizes a flexible cord in addition to the trigger and holding member; the cord is looped around the bowstring and holds it until the trigger is depressed. Additionally, there are other types of releases in current use employing these principles and various combinations of structural components.

However, regardless of the type, a number of the releases of the prior art require that the bowstring be loaded into a slot in the body of the release, or the device is otherwise constructed such that it is difficult to employ the release rapidly and blindly (i.e., without looking at the release and the bowstring during the loading procedure prior to drawing the bowstring). This is not a significant problem in target archery where there is adequate time between each shot to properly engage the release on the bowstring. However, such releases are generally unsatisfactory for hunting where the shooter must keep his eye on the game. Furthermore, a hunter prefers the opportunity for a second shot if possible so speed in reloading is of utmost importance.

It is, therefore, the primary object of the present invention to provide an archery release that overcomes the disadvantages discussed above and, therefore, is especially suitable for hunting.

As a corollary to the foregoing object, it is an important aim of this invention to provide a release as aforesaid which can be quickly and easily engaged on the bowstring and the bow then drawn, aimed and fired while the shooter's eyes remain on target.

Another important object is to provide a hunting release of the trigger-operated type which automatically instantly resets after the bowstring is released in order to permit rapid initial shots and repeat shots with no make-ready or loading of the release being required.

Still another important object of this invention is to provide a trigger-operated archery release in which the bowstring is engaged well ahead of the shooter's hand, thereby permitting the shooting arm to be pulled rearwardly so that the bow arm, shoulders and shooting arm are all in line, rather than the shooting arm elbow projecting at an angle (typically about 35°) to a line through the shoulders and bow arm. Accordingly, holding and aiming are much more stable, and the tendency of "creeping" the arrow forward while at full draw is reduced.

Still another important object of this invention is to provide such an archery release in which the forward tip thereof is constructed and arranged to allow the bowstring to be in line with the shooter's eye at any face anchor, and which permits the archer to use a chin anchor or under-chin anchor if desired.

Furthermore, it is a general object of this invention to provide a trigger-operated archery release especially suitable for hunting wherein the component parts thereof are arranged to assure maximum accuracy in the flight of the arrow.

Also, it is a specific object of this invention to provide a trigger-operated release having an open hook which engages and holds the bowstring and spaces the same from the body of the release to prevent kinking of the bowstring should the archer inadvertently rotate the release from a normal, level attitude.

Another specific object of this invention is to provide a trigger-operated release having a rigid body especially configured to be gripped and employed by the archer quickly and blindly.

Yet another object of the invention is to provide an archery release that can be used interchangeably by right- or left-handed shooters without adjustment.

DETAILED DESCRIPTION

Figure 1:
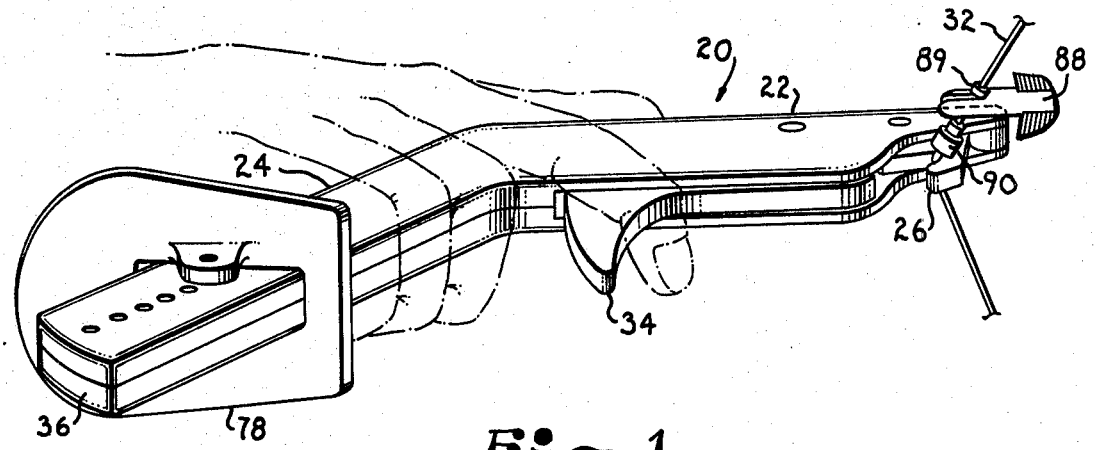
FIG. 1 is a perspective view of the release of the present invention showing the archer's hand thereon and the hook of the release in engagement with the bowstring.

Referring initially primarily to FIGS. 1–5 and 8, the release of the present invention comprises an elongated, rigid body or case 20 of dogleg configuration having an elongated, front firing portion 22 that merges at its rear with an elongated, rear handle portion 24. An open hook 26 projects laterally outwardly from the outer longitudinal side 28 of the firing portion 22 and is completely clear of the body 20 as is evident in FIGS. 1 and 2, the hook 26 having a recess 30 therein normally spaced from side 28 for receiving and capturing a bowstring 32 as illustrated in FIGS. 1–3, and 8. The release is operated by a trigger 34 which projects laterally from side 28 and is spaced rearwardly from the hook 26 and just forward of the handle portion 24. An archer's hand is shown in FIG. 1 loosely gripping the handle portion 24 with the index finger positioned on trigger 34, the release being illustrated in the shooting position where the device is preferably held in a level attitude against the side of the archer's face or under the chin depending upon the anchor point desired.

The elongated case 20 is preferably approximately 10 inches (25 cm.) in length from its rear end 36 to its front, free end 38 around the dogleg, and has a width of $\frac{7}{8}$ inch (2.2 cm.) in the handle portion 24 increasing to 1 inch (2.54 cm.) in the firing portion 22, and a thickness of $\frac{2}{3}$ inch (1.7 cm.). Accordingly, the body or case 20 of the release is conveniently hand-held as illustrated and, for durability, may be constructed by nylon and hardened tool steel where required.

Figure 6:
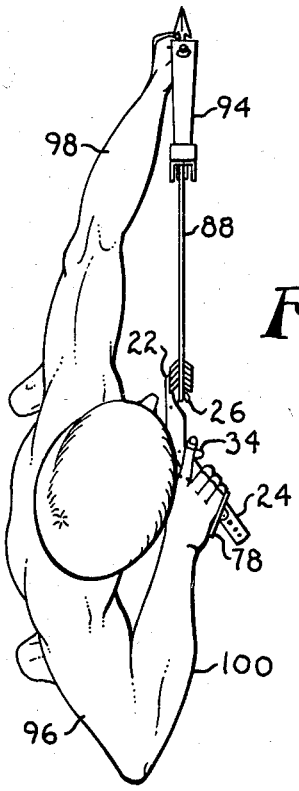
FIG. 6 is a view looking down on an archer who is using the release of the present invention and is holding the bowstring (not shown for clarity) at full draw.

The longitudinal side 28 is referred to herein as the outer side of the case 20 since this is the side that faces laterally away from the archer when the release is held in the shooting position. Likewise, the opposite longitudinal side 40 of the case 20 presents the inner side thereof since this side faces laterally toward the archer when the release is in use as illustrated in FIGS. 1 and 6. This relationship of the two longitudinal sides 28 and 40 is the same regardless of whether the release is used by a right- or left-handed shooter, as the device may be interchangeably employed without adjustment. It should be noted that the elongated firing and handle portions 22 and 24 diverge 30° from straight alignment due to the dogleg configuration, and form an obtuse angle of 150° at the outer longitudinal side 28. This angle accommodates the human hand and wrist joint so that the front firing portion 22 of the case 20 points in the general direction of the target without strain, as illustrated in FIG. 6.

Figure 8:
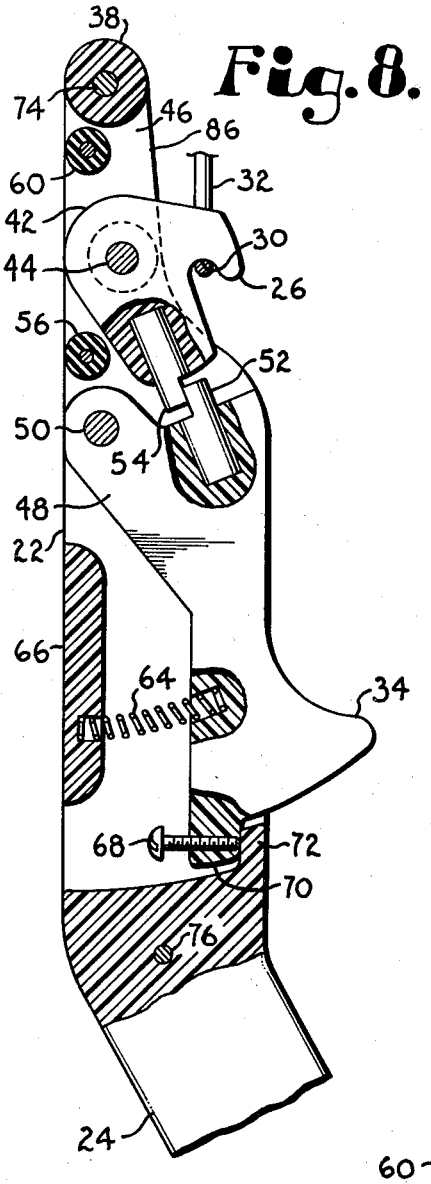
FIG. 8 is an enlarged, fragmentary, top plan view of the release as in FIG. 2 but with the top of the body of the release broken away to reveal the internal construction.

Particularly in FIG. 8, it may be seen that the hook 26 is formed on one side of a rotary holding member 42 which rotates on a pin 44. The member 42 and the trigger 34 are housed in a longitudinally extending cavity 46 in the firing portion 22, the trigger 34 being provided with an integral arm 48 which extends into the cavity 46 and is mounted on a pivot pin 50. It may be seen that the exposed portion of the trigger 34 which is depressed by the archer is remote from the pin 50; thus the trigger 34 swings through a limited arc about the axis established by pin 50. It should be noted that the axes provided by pins 44 and 50 are parallel and extend vertically when the release is properly held in a normal shooting position.

Figure 9:
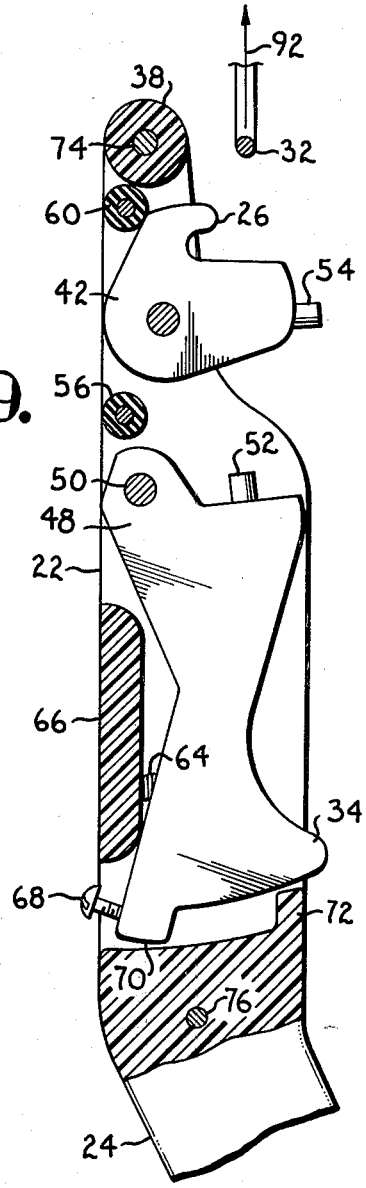
FIG. 9 is a view similar to FIG. 8 but with the trigger depressed and the hook rotated to a position releasing the bowstring.

A metal insert in the arm 48 presents a sear 52 which projects forwardly from the trigger 34 for engagement by a cooperating part 54 on the member 42 that is also formed by a metal insert for durability. In the orientation of member 42 shown in FIG. 8 where the hook 26 is engaging and holding the bowstring 32, the part 54 is disposed rearwardly of the hook 26 and projects rearwardly from the member 42 for engagement by the sear 52. A stop 56 (preferably rubber-cushioned for silent operation) is located just forwardly of the trigger pivot pin 50 and limits the return movement of the member 42 under the action of a helical return spring 58 (FIGS. 7 and 10) as will be discussed. A second rubber-cushioned stop 60 is spaced forwardly from the pin 44 upon which member 42 pivots, and limits the rotation of the member 42 when the bowstring 32 is released as depicted in FIG. 9.

Figure 7:
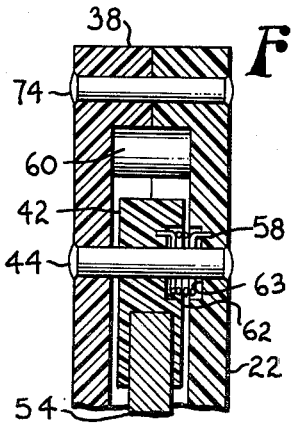
FIG. 7 is an enlarged, cross-sectional view taken along line 7—7 of FIG. 2.

The helical spring 58 is disposed in a circular recess 62 in member 42 and a registering recess 63 in the case as best seen in FIG. 7, and is secured to the member 42 such that it is at all times biased toward the normal, bowstring-engaging position thereof shown in FIG. 8. A return spring 64 for the trigger 34 operates between a boss 66 and the back of the trigger 34 as is apparent in FIG. 8. In order to form the longitudinally extending cavity 46 which houses the movable components, the case 20 is preferably constructed of upper and lower halves (see FIGS. 3 and 5) which are recessed in the firing portion 22 to provide the cavity 46 and a longitudinal opening 67 in the outer side 28 through which the hook 26 and exposed portion of the trigger 34 project.

The travel of the trigger 34 is adjusted by a screw 68 threaded through a projection 70 on the rear end of the trigger 34 which abuts a shoulder 72 to limit outer movement of the trigger 34 under the action of the return spring 64. The setting shown in FIG. 8 provides maximum trigger travel before release; travel is decreased by rotating the screw 68 to space the projection 70 away from the shoulder 72 and thereby reduce the area of engagement of the sear 52 with the part 54.

The two halves of the case 20 are secured together by crosspins such as illustrated at 74 adjacent the free end 38 of the case (FIG. 8) and at 76 in the zone of merger of the firing portion 22 with the handle portion 24. A butt plate 78 has a clearance opening 80 therein through which the handle portion 24 extends, and is pivotally mounted on the handle 24 by a hinge pin 82. A series of spaced holes 84 through the handle 24 provides a means of adjusting the butt plate 78 to accommodate the archer's hand, by withdrawing the hinge pin 82 and inserting it at the desired hole 84. The butt plate 78 is self-centering due to the pivotal mount and receives the heel of the hand to distribute the draw pressure comfortably on the heel, and allows the archer to hold the bowstring 32 at full draw without tensely gripping the handle 24 with the fingers.

Figure 2:
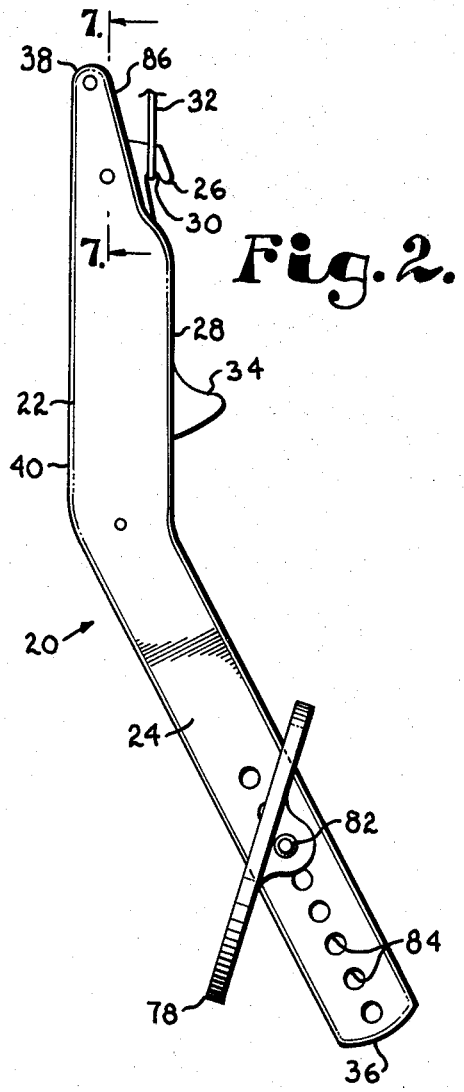
FIG. 2 is a top plan view of the release, the hook being shown engaging the bowstring (the stop bead is removed from the string for clarity of illustration)

As is particularly evident in FIG. 2, the firing portion 22 of the case 20 has a tapered tip 86 terminating at the free end 38. Although the inner longitudinal side 40 along the firing portion 22 is straight, the outer side 28 is tapered from a point between the exposed portion of the trigger 34 and the hook 26, thereby converging toward the inner side 40 in the direction of the free end 38. The narrow, tapered tip 86 allows the bowstring 32 to be in line with the eye of the archer at any face anchor, and the flat upper surface at the tip provides a solid under-chin anchor if desired.

Figure 3:
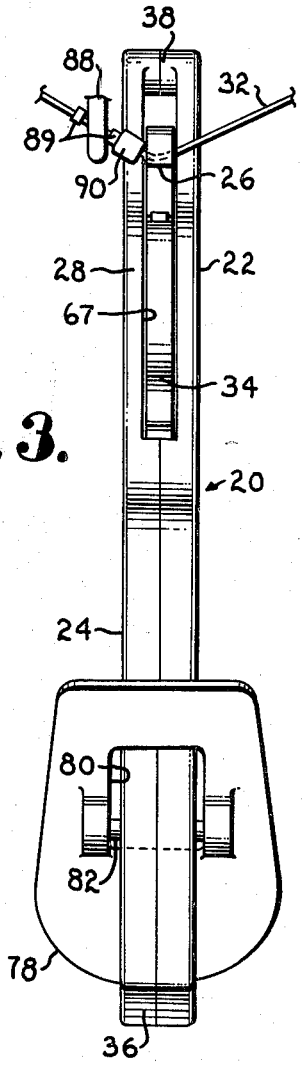
FIG. 3 is a side view of the release as shown in FIG. 2, the stop bead and the arrow nock being illustrated.
Figure 4:
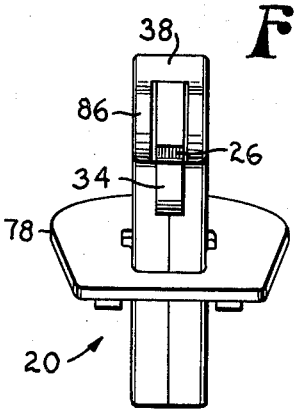
FIG. 4 is a front end view of the release.
Figure 5:
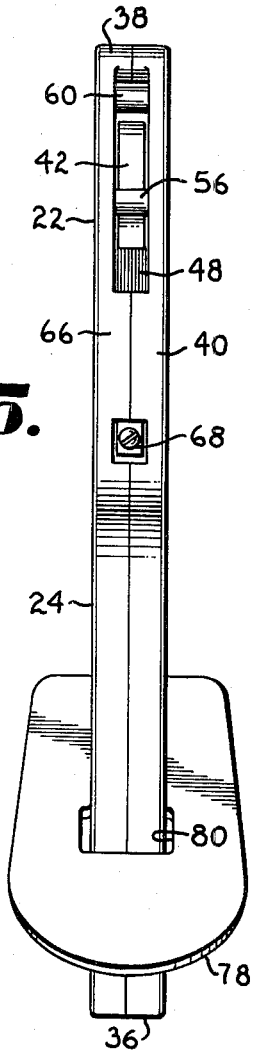
FIG. 5 is a view of the side of the release opposite to the side shown in FIG. 3.
Figure 10:
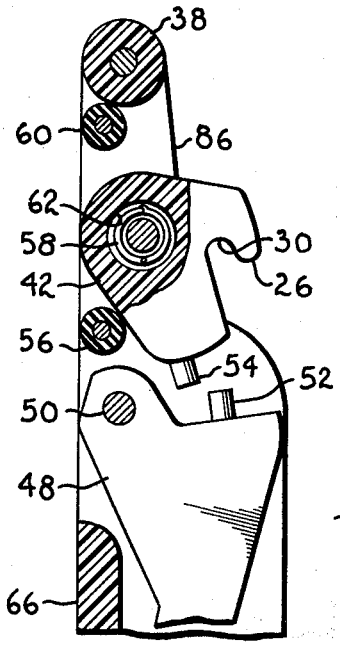
FIG. 10 is a view showing the movable components subsequent to the FIG. 9 condition after the hook has been reset but prior to return of the trigger.

In use, the movable components of the device are in their normal positions as depicted in all of the figures except FIGS. 9 and 10. The archer nocks an arrow 88 on the bowstring 32 and then engages the bowstring with the hook 26 of the release. The rigid dogleg case 20 enables the hook 26 to be positively positioned by the archer and, together with the side exposure of the hook 26, permits the release to be employed blind so that the archer's eyes remain on the target. The archer then rapidly slides the hook 26 up to a stop bead 90 which is one of two rubber beads secured to the bowstring 32 as an aid to rapid shooting and sighting. (A pair of spaced, nock-locating elements 89 may be clamped to the bowstring 32 as shown in FIGS. 1 and 3 to define the nocking point just above the stop bead 90.) An upper bead (not shown) may also be employed to establish a line of sight through the particular sighting device used by the archer and which is mounted on the handle of the bow.

The bowstring 32 is then drawn in the usual manner and, once aim has been taken on the target, the arrow 88 is released by simply squeezing the trigger 34. This is illustrated in FIG. 9 where it may be seen that the sear 52 has disengaged the part 54 thereby permitting the holding member 42 to rotate in a counterclockwise direction about pin 44 to an operated position releasing the bowstring 32. Accordingly, it may be appreciated that the hook 26 moves along an arcuate path of travel while the bowstring 32 travels in a straight line (illustrated by arrow 92) as it is released from the hook. The bowstring 32 is at all times held completely clear of the case 20 since the bowstring-receiving recess 30 of the hook 26 is spaced away from the outer side 28 of the tapered tip 86. Furthermore, this arrangement prevents the archer from inadvertently kinking the string 32 prior to release, which could occur if the case 20 is held at a somewhat canted attitude rather than level. Even if canted or tilted, the string 32 is not permitted to contact the case structure.

Once the release has been operated, the hook 26 and the trigger 34 are automatically reset by the action of the return springs 58 and 64. The holding member 42 returns instantly and engages the stop 56 (FIG. 10). When the archer releases pressure on the trigger 34, the trigger returns to its normal position as shown in FIG. 8 where the sear 52 engages the part 54. Accordingly, the release of the present invention is instantly ready for the next shot, whether the first shot at a new target or a repeat shot, and it remains in a constant ready condition until such shot is executed.

Referring to FIG. 6, an archer is shown holding a compound bow 94 at full draw utilizing the release of the present invention. It should be noted that the hook 26 (and hence the bowstring which is not shown for clarity) is well ahead of the archer's hand, the spacing between the front of the exposed portion of trigger 34 and the string-receiving recess 30 being approximately two inches (five centimeters). This allows the upper arm 96 of the archer's right arm to be in alignment with his shoulders and the left arm 98 which is holding the bow 94. Therefore, the shooting hand, arms and shoulders remain in a more comfortable, straight-line, locked position so that less effort is required at full draw and holding and aiming are much more stable.

It should also be appreciated that the hook 26 extends in front of the bowstring 32 from the left side (for a right-handed shooter) in contrast to use of the fingers of the right hand as in the historical Mediterranean finger release. It is believed that this eliminates archer's paradox and contributes to straight-line flight of the arrow. Furthermore, the trigger is actuated by a rearward sliding pull rather than a laterally directed force applied by the archer's trigger finger, so that the trigger actuating force is in line with the pull force through the bow, shoulders and shooting arm.

Having thus described the invention, what is claimed as new and desired to be secured by Letters Patent is:

1. A trigger-operated bowstring release comprising:

an elongated, relatively narrow, rigid body of dogleg configuration having an elongated front firing portion merging with an elongated rear handle portion provided with a configuration adapting said handle portion to be gripped in the palm of an archer's hand, said portions being angularly disposed with respect to each other to present said dogleg configuration, stop means on said handle portion spaced from said firing portion for receiving the heel of an archer's hand when the handle portion is gripped, said firing portion having opposed, inner and outer longitudinally extending sides facing laterally toward an archer and laterally away from the archer respectively when the handle portion is gripped by the archer and the release is held in a shooting position adjacent the archer's head with said firing portion extending forwardly from said handle portion and pointing generally in the direction of a target, said outer side of the firing portion and said handle portion defining an obtuse angle thereby providing the dogleg configuration, a holding member associated with said firing portion and provided with an open hook for engaging and holding a bowstring, and said member having a normal, bowstring-holding position in which the hook is spaced from said body forwardly from said handle portion and projects laterally from said outer side clear of said body to hold the bowstring, permitting the release when held by the archer to be moved to a disposition of unobstructed engagement with the bowstring merely by the archer manipulating the entire body, means on said firing portion mounting said member for movement between said normal position and an operated, bowstring-releasing position, a trigger provided with a sear, and means on said firing portion mounting said trigger rearwardly of said member for movement between a normal position where the sear engages said member to retain it in its normal, bowstring-holding position and the trigger projects laterally from said outer side, and an operated position assumed upon depressing the trigger and in which the sear is disengaged from the member to permit the same to move to its bowstring-releasing position under the force of a bowstring received in said hook.

2. The release as claimed in claim 1, wherein said trigger in its normal position is in substantial alignment with a line of pull force through the bowstring and along the shooter's forearm when the release is held in the shooting position, and wherein said trigger mounting means provides for said movement of the trigger from its normal to its operated position in response to a rearwardly directed actuating force in substantial alignment with said line of pull force.

3. The release as claimed in claim 1, wherein said hook presents a recess for receiving and capturing the bowstring, said recess being laterally spaced from said outer side of the firing portion when the holding member is in its normal, bowstring-holding position, whereby the bowstring is spaced away from the body of the release to prevent inadvertent kinking of the string.

4. The release as claimed in claim 3, wherein said body has a tapered, front tip presenting the free end of said firing portion, said hook projecting laterally outwardly from the tapered tip when said member is in its normal, bowstring-holding position.

5. The release as claimed in claim 4, wherein said tip is tapered along said outer side.

6. The release as claimed in claim 5, wherein said inner side is straight from said handle portion to said end.

7. The release as claimed in claim 1, wherein said means mounting said member supports the same for rotary movement between said positions thereof to define an arcuate path of travel for said hook.

8. The release as claimed in claim 7, wherein said means mounting said trigger supports the same for rotary movement between said positions thereof, and wherein the axes of rotation of said member and said trigger are parallel to each other and disposed at right angles to the elongation of said firing portion, and extend generally vertically when the release is held in the shooting position.

9. The release as claimed in claim 1, further comprising means engaging said member and said trigger for returning the same to their normal positions after the bowstring is released to reset the hook and trigger, whereby to permit rapid initial and repeat shots.

10. The release as claimed in claim 1, wherein said obtuse angle is approximately 150°.

11. The release as claimed in claim 1 wherein said stop means comprises a butt plate for receiving the heel of the archer's hand, and means pivotally securing said plate to said handle portion for movement to a disposition to accommodate the archer's hand and distribute the draw pressure on the heel of the hand.

12. The release as claimed in claim 1, further comprising reset means engaging said member and said trigger for immediately returning the member to its normal position after the bowstring is released and for returning the trigger to its normal position upon removal of actuating force therefrom, whereby the hook and trigger are reset to permit rapid initial and repeat shots.

13. A trigger-operated bowstring release comprising:

an elongated, rigid body having a front firing portion and a rear handle portion and having generally the configuration of a pistol with said handle portion being adapted to be gripped in the palm of an archer's hand;

a holding member associated with said firing portion and provided with an open hook for engaging and holding a bowstring, and said member having a normal, bowstring-holding position in which the hook is spaced from said body forwardly from said handle portion and projects laterally in a plane substantially perpendicular to the plane formed by the bowstring and bow from said firing portion clear of said body to hold the bowstring, permitting the release when held by the archer to be moved to a disposition of unobstructed engagement with the bowstring merely by the archer manipulating the entire body;

means on said firing portion mounting said member for movement between said normal position and an operated, bowstring-releasing position;

trigger means for holding said member in its normal position and for releasing said member when the trigger means is squeezed;

means on said firing portion mounting said trigger means for movement between a normal position holding said member and where a portion of the trigger means projects laterally from said firing portion, and an operated position assumed upon depressing said portion of the trigger means and in which the member is permitted to move to its bowstring-releasing position under the force of a bowstring received in said hook; and reset means engaging said member and said trigger means for immediately returning the member to its normal position after the bowstring is released and for returning the trigger means to its normal position upon removal of actuating force therefrom, whereby the hook and trigger means are reset to permit rapid initial and repeat shots.

14. The release as claimed in claim 13, wherein said reset means comprises spring means biasing said member and said trigger means toward their normal positions.

15. The release as claimed in claim 14, wherein said firing portion houses said member and said trigger means, there being a stop in said firing portion disposed for engagement by said member under the action of said spring means to limit return movement of said member, said trigger means and said member having cooperating parts including a sear engageable with one another upon said return movement of the member to said stop and upon return movement of said trigger means to its normal position under the action of said spring means.

16. The release as claimed in claim 15, wherein said means mounting said member supports the same for rotary movement between said positions thereof to define an arcuate path of travel for said hook.

17. The release as claimed in claim 16, wherein said means mounting said trigger means supports the same for rotary movement between said positions thereof, and wherein the axes of rotation of said member and said trigger means are parallel to each other and extend generally vertically when the release is held in a shooting position.

18. A trigger-operated bowstring release comprising:

an elongated, rigid body having a front firing portion and a rear handle portion and having generally the configuration of a pistol with said handle portion being adapted to be gripped in the palm of an archer's hand, said firing portion having opposed, inner and outer longitudinally extending sides facing laterally toward an archer and laterally away from the archer respectively when the handle portion is gripped by the archer and the release is held in a shooting position adjacent the archer's head with said firing portion extending forwardly from said handle portion and pointing generally in the direction of the target;

a holding member associated with said firing portion and provided with an open hook for engaging and holding a bowstring, and said member having a normal, bowstring-holding position in which the hook is spaced from said body forwardly from said handle portion and projects laterally from said outer side clear of said body to hold the bowstring, permitting the release when held by the archer to be moved to a disposition of unobstructed engagement with the bowstring merely by the archer manipulating the entire body;

means on said firing portion mounting said member for movement between said normal position and an operated, bowstring-releasing position;

a trigger provided with a sear; and means on said firing portion mounting said trigger rearwardly of said member for movement between a normal position where the sear engages said member to retain it in its normal, bowstring-holding position and a portion of the trigger projects laterally from said outer side, and an operated position assumed upon depressing said portion of the trigger and in which the sear is disengaged from the member to permit the same to move to its bowstring-releasing position under the force of a bowstring received in said hook, said portion of the trigger being spaced sufficiently rearwardly of said open hook to permit a fully drawn bow to be held with the archer's bow-holding arm, shoulders and upper shooting arm in substantial alignment.

19. The release as claimed in claim 18, wherein the spacing between said open hook and the front of said portion of the trigger is approximately two inches.

20. A trigger-operated bowstring release comprising:

an elongated, rigid body having a front firing portion and a rear handle portion provided with a configuration adapting said handle portion to be gripped in the palm of an archer's hand, said firing portion having opposed, inner and outer longitudinally extending sides facing laterally toward an archer and laterally away from the archer respectively when the handle portion is gripped by the archer and the release is held in a shooting position adjacent the archer's head with said firing portion extending forwardly from said handle portion and pointing generally in the direction of the target;

a holding member associated with said firing portion and provided with an open hook for engaging and holding a bowstring, and said member having a normal, bowstring-holding position in which the hook is spaced from said body forwardly from said handle portion and projects laterally from said outer side clear of said body to hold the bowstring, permitting the release when held by the archer to be moved to a disposition of unobstructed engagement with the bowstring merely by the archer manipulating the entire body;

means on said firing portion mounting said member for movement between said normal position and an operated, bowstring-releasing position, said hook presenting a recess for receiving and capturing the bowstring and which is laterally spaced from said outer side of the firing portion when said member is in its normal, bowstring-holding position, whereby the bowstring is spaced away from the body of the release to prevent inadvertent kinking of the string;

trigger means for holding said member in its normal position and for releasing said member when the trigger means is squeezed; and means on said firing portion mounting said trigger means for movement between a normal position holding said member and where a portion of the trigger means projects laterally from said outer side, and an operated position assumed upon depressing said position of the trigger means and in which the member is permitted to move to its bowstring-releasing position under the force of a bowstring received in said recess.

* * * * *